US005992313A

United States Patent [19]

Zimmer

[11] Patent Number: 5,992,313

[45] Date of Patent: Nov. 30, 1999

[54] APPLICATOR DEVICE

[76] Inventor: Johannes Zimmer, Ebentaler Strasse 133, 9020 Klagenfurt, Austria

[21] Appl. No.: 09/051,303

[22] PCT Filed: Oct. 17, 1996

[86] PCT No.: PCT/EP96/04491

§ 371 Date: Jul. 8, 1998

§ 102(e) Date: Jul. 8, 1998

[87] PCT Pub. No.: WO97/14560

PCT Pub. Date: Apr. 24, 1997

[30] Foreign Application Priority Data

Oct. 17, 1995 [DE] Germany ..... 295 17 099 U

[51] Int. Cl.[6] ..... B41L 13/00

[52] U.S. Cl. ..... 101/120; 101/116; 101/479

[58] Field of Search ..... 101/114, 116, 101/117, 118, 119, 120, 129, 479

[56] References Cited

U.S. PATENT DOCUMENTS 5,239,922 8/1993 Zimmer ..... 101/120

FOREIGN PATENT DOCUMENTS 46952 3/1982 European Pat. Off. .

463699 1/1992 European Pat. Off. .

612615 8/1994 European Pat. Off. .

2040227 8/1980 United Kingdom .

*Primary Examiner*—Ren Yan

*Attorney, Agent, or Firm*—Beall Law Offices

[57] ABSTRACT

A doctor arrangement is located inside a rotary cylindrical screen for applying a substance to a moving web that is adjacent the rotary screen. The doctor is supported on a carrier beam that is mounted within the rotary screen. The substance is applied through the rotary screen onto the moving application surface with the doctor, which may be a roll doctor or doctor blade. The carrier beam is slidable along a longitudinal axis of the rotary screen into and out of the rotary screen through a through hole in a bearing of the rotary screen at one end of the apparatus. The carrier beam has guide rails that slide along guide rolls mounted outside the width of the application surface on bearings that the rotary screen. The carrier beam and doctor arrangement can be inserted and withdrawn from the rotary screen with the carrier beam in an elevated position wherein the doctor does not interfere with the rotary screen member. In the application position in which the substance is being applied, the carrier member can be supported by the guide rails and guide roll after being adjusted to the appropriate height, or by a separate bearing block arrangement that supports the carrier beam and correspondingly the doctor arrangement.

17 Claims, 5 Drawing Sheets

APPLICATOR DEVICE

FIELD OF THE INVENTION

The invention concerns an application apparatus for applying substance, in particular by means of a perforated cylinder rotary screen, to a moving surface, web or similar application surface with a carrier beam extending along the apparatus length across the application width, a doctor device connected to the carrier beam and a carrier beam mounting arranged at tire end face of the apparatus for mounting the carrier beam by both of its ends outside the application width.

Particularly for application apparatus such as rotary screen printing machines it is necessary to re-equip the printing machine having a multiple of printing units in which the doctor assemblies have to be exchanged at short time intervals, owing to the small application sizes customary in textile printing. The installation of the doctor assembly constituted by a carrier beam and doctor device is generally effected such that at first a carrier beam holder, which is at the side or the printing machine at which the doctor assembly is to be inserted into the rotary screen, is removed by lowering it, swinging it away or otherwise. Subsequently the doctor assembly is rotated manually by 180° about the carrier beam, the doctor assembly thereby coming to rest upwardly, and then manually inserted into the rotary screen. To facilitate handling, the carrier beam rear side is frequently supported on the edge of the bearing opening of the rotary screen mounting and shunted to slide across this edge which results in wear and, in particular for large print widths, in the danger that damage to the screen results. The dismounting of the doctor assembly takes place in a corresponding manner. All in all the free manual setting up of the rotary screen printing machine is associated with considerable difficulties and disadvantages. The doctor assemblies can be handled only with difficulty owing to their large lengths (usually up to 3200 mm, 4200 mm including carrier beam) and the considerable weight (up to 35 kg) as well as the relatively small inner diameter (130–150 mm) of the end face bearing ring of the rotary screen. When setting up the printing machine there is a danger that the extremely sensitive doctor elements such as doctor blades and roll doctors are damaged and become unusable or that personnel occupied with the re-equipping injure themselves on the sharp doctor blades. When the doctor apparatus is swung upwardly by 180° during dismounting, of leads to the soiling with dye of the normally clean apparatus portions as a result of dripping falling application substance so that a higher cleaning cost with regard to the amount of washing liquid, cleaning the and cleaning apparatus is necessary.

The development of doctor assembly technology tends towards ever longer, heavier doctor devices with ever larger carrier beam sections so that the stated difficulties in handling the doctor assemblies and particularly the amount of time for setting up rotary screen printing machines are increased. In particular considering the aspect of the already mentioned small application areas and the presence of a multiple of printing units with doctor assemblies to be exchanged in one printing machine (currently up to 24) an improved rapid handling gains considerably in importance.

SUMMARY OF THE INVENTION

The invention is therefore based on the object, to improve an apparatus of the type mentioned in the introduction such that the mounting and dismounting of the carrier beam with doctor device is essentially simplified and accelerated and also becomes less expensive, the working safety is increased, the risk of injury of operating personnel is reduced and the risk of damage to the apparatus components substantially decreased.

According to the invention this object is achieved in combination with the features of the application apparatus mentioned in the introduction in that at least one holding rail is formed on the carrier beam to extend with the latter continuously over at least the greatest part of the length of the latter and that a rail guide which forms a rail mounting and receives and guides the associated carrier beam rail for mounting and dismounting the carrier beam is provided in the region of at least one end face of the apparatus, the doctor device coming to rest at the carrier beam underside opposing the application surface. By means of the rail mounting according to the invention a guided set-up suspension of the doctor assembly is obtained with which the handling upon mounting and dismounting is essentially simplified. The risk of damage to apparatus parts is considerably reduced. Unlike conventional handling the doctor device remains, as a result of rail-guided carrier beam, constantly below the latter so that not only is the otherwise present risk of falling eliminated but also conventional soiling with dye that occurs generally as a result of overhead handling of the doctor assembly is prevented. The otherwise present cleaning cost is obviated. The re-equipping time is considerably reduced and the productivity of an application apparatus, particularly with a plurality of printing units is thereby essentially increased. Also, the hitherto existing limits in the development of printing machines for larger widths and thus also for the use or larger and heavier doctor assemblies in combination with the handling and cleaning difficulties are removed as a result of the apparatus according to the invention.

A particularly advantageous embodiment of the invention consists of the arrangement of the rail mounting on one rotary screen printing unit. Installation and dismounting of the doctor assembly through the relatively narrow screen end opening and the positioning inside the screen are very safe and easy.

Usefully one holding rail, respectively, can be formed on the lateral longitudinal sides of the carrier beam in the upper region of the latter. A particularly advantageous arrangement consists in that the rail guide comprises guide rolls and/or sliding blocks arranged in pairs, one rail guide part, respectively, of each of the pairs being provided to oppose one another across a clear distance which permits the passage of the carrier beam section.

Guide parts such as guide rolls or sliding blocks can usefully have a lateral guide flange or roller flange for laterally guiding the holding rails. In correspondence with the arrangement of the rail guide the holding rail can particularly usefully be constituted by simple angle rails or angle rails with a downwardly bent edge. With the downwardly bent edge the rail forms a sliding fit adapted to the profile section of the rolls or sliding blocks so that the rails cannot run untrue. The bent angle rails can advantageously be provided in combination with a simple angle rail. An adaptation to the clearance of the guide parts of the rail guide for different carrier beam cross sections or diameters can then occur in an easy manner as a function of the transverse extension of the free leg of the unbent rail lying on the associated guide part.

In accordance with a particularly advantageous embodiment of the invention the carrier beam holder comprises, at the end side of the apparatus at which the doctor arrangement is inserted or withdrawn, a stand firmly connected to the apparatus with a double arm pivotal about the stand having a carrier beam mounting arm and a holding arm for an upwardly extending support rod that can engage an associated carrier beam rail with a head support surface when the rail is inserted into the rail guide or leaves the latter.

A particularly advantageous embodiment of the invention consists in that the carrier beam mounting is simultaneously formed by the rail guide. By means of this is thus effected not only the continuously guided installation and dismounting of the doctor arrangement, but the doctor arrangement remains connected to this mounting even after installation, the rail guide mounting then holding the doctor assembly in its operating position.

Other useful and advantageous embodiments of the invention are apparent from the dependent claims.

BRIEF DESCRIPTION OF THE DRAWINGS

Particularly useful and advantageous embodiments or arrangement possibilities of the invention will be described in more detail by the following description of the embodiments shown in the schematic drawings.

DETAILED DESCRIPTION OF THE PREFERRED EMBODIMENTS

Figure 2:
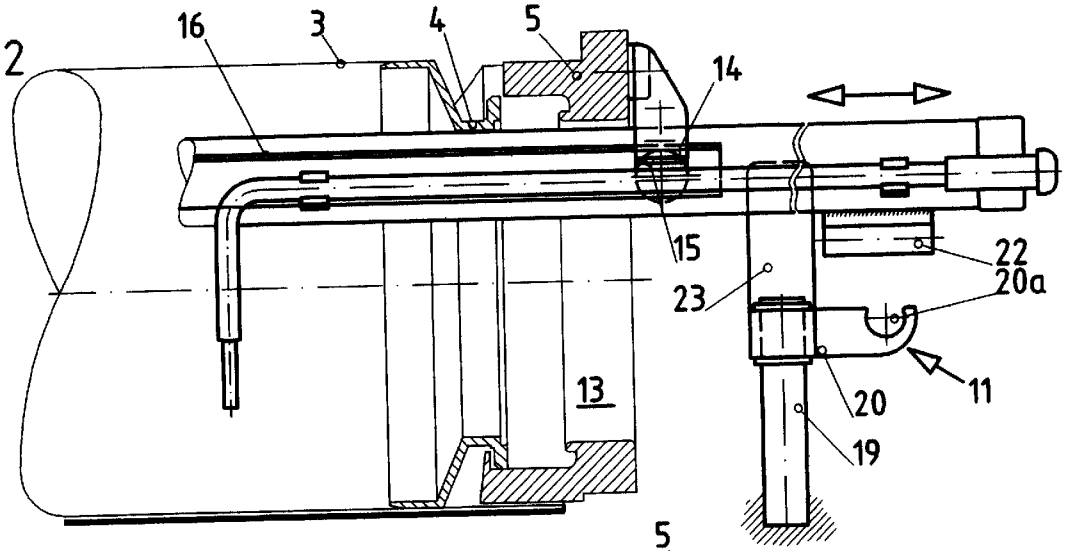
FIG. 2 a partial longitudinal side view of the printing unit of FIG. 1 partially in section and without showing the doctor device.

Apparatus serving as printing units of a rotary screen printing machine comprise a perforated cylinder rotary screen 3 arranged above a transport belt 1 and a doctor arrangement arranged, or to be mounted, in the perforated cylinder rotary screen. A web 2 forming an application surface lies on the transport belt 1. The rotary screen 3 comprises bearing rings 4 at its ends with which it is mounted for rotation in a screen mounting 5 fixed to the apparatus.

Figure 1:
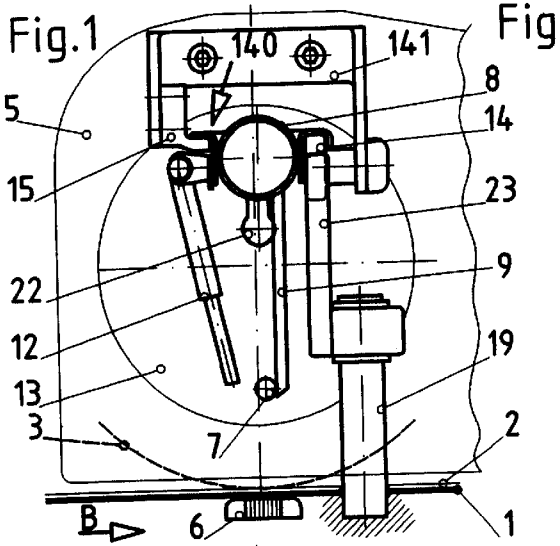
FIG. 1 is a frontal view of the mounting and dismounting side (installation side) of an application apparatus according to the invention in the form of the printing unit of a rotary screen printing machine during the mounting or discounting phase of the doctor device.
Figure 3:
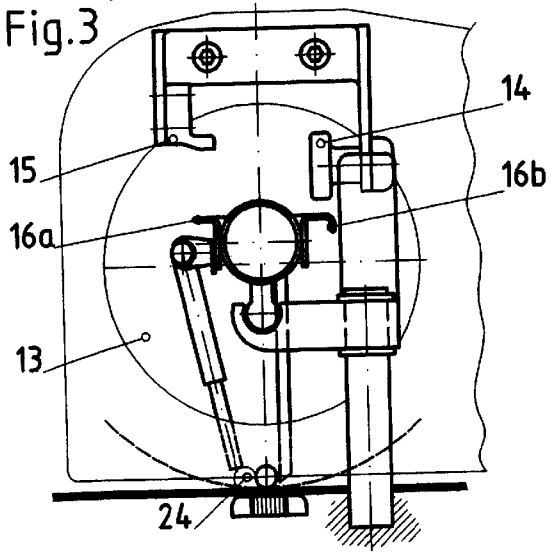
FIG. 3 is a frontal view of the printing unit of FIG. 1 on the installation side with the doctor device in printing operation position.

As shown in FIGS. 1 and 3, the doctor arrangement specifically comprises a carrier beam 8, a holding strip 9 connected to the latter without rotation and a roll doctor 7 carried by the holding strip. The magnetizable roll doctor 7 is held at the free lower edge of the holding strip 9 by a not shown holding magnet. In the print operating state the roll doctor 7 is pressed against the rotary screen 3 by means a magnet bar 6 arranged below the transport belt 1 to apply colour substance 24 to the web 2 conveyed in the working direction B. In the embodiments according to FIGS. 7*a* to 8*b* a doctor blade 10 is attached to the holding strip 9.

The carrier beam 8 which, in its mounted state, extends through both end openings of the rotary screen formed by the bearing rings 4 and the corresponding circular openings 13 of the screen mounting 5 is then supported and held at its ends located outside the rotary screen 3 by a carrier beam mounting 11, respectively. In the drawing, only the carrier beam mounting seats lying on the mounting/dismounting side (installation side) of the doctor device are shown. The carrier beam 8, by means of which the supply of colour substance 24 over the application width is also effected, is formed according to FIGS. 1 to 8 as a pipe-like hollow structure with a circular or, as apparent from FIG. 6*a* and FIGS. 7*a* and *b*, rectangular cross section.

To substantially simplify the mounting and dismounting of the doctor arrangement with the doctor device which is integrated in, or extends below, the carrier bean, a rail guide 140 is formed according to the invention, as shown in FIGS. 1 to 8*b*, in the upper region of the opening 13 defined by the inner diameter of the screen mounting 5 or the bearing ring 4, through which the carrier beam 8 is inserted into the rotary screen 3 together with the doctor device and a substance sensor 12 disposed on the carrier beam, and at the side face directly in front of this opening 13, the rail guide comprising in accordance with FIGS. 1 to 5*b* a stationary guide roll 14 with a horizontal mounting axis perpendicular to the longitudinal axis of the apparatus and a stationary sliding block or support 15 that are horizontally displaced at the same height above the application surface 2 and in particular are attached to the end face screen mounting wall 5 by means of a downwardly open U-shaped carrier stirrup 141 (FIGS. 1 to 5*a*)

As apparent from FIGS. 7*a* to 8*b* the rail guide 140 may also usefully comprise as guiding parts a pair of guide rolls 14' which are advantageously provided with a guide flange or roller flange 4*a* to limit lateral guidance.

Figure 8A:
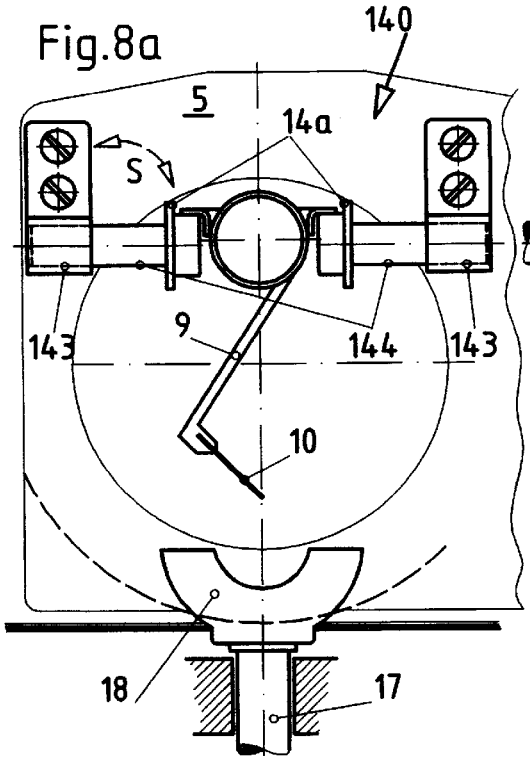
Figure 8B:
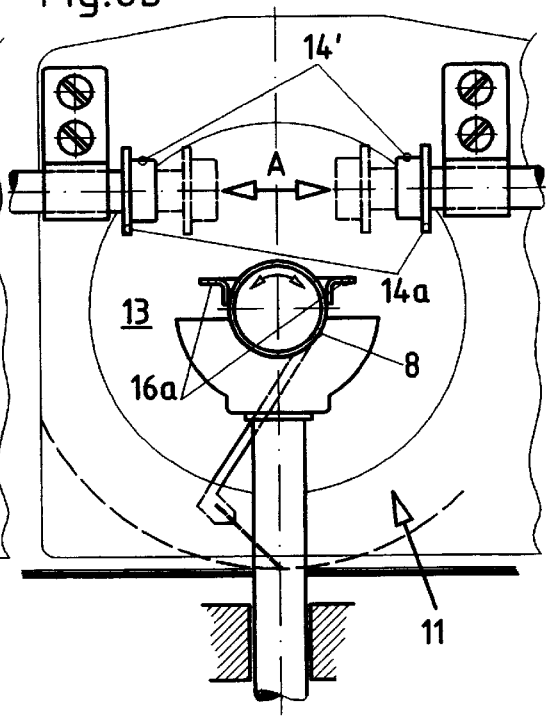

It is further particularly advantageous to arrange the rail guide parts in mountings by means of which they are displaceable transversely to the carrier beam guide direction and so as to modify the distance between the rail guide parts. Mountings 143 of this type are shown with a dashed line in FIGS. 8*a* and *b*. The guide roll 14' is arranged on a shaft 144 that is inserted in a mounting hole forming the mounting 143 to be slidably movable in the axial direction A and fixable in the desired position. The axis of rotation of the roll is flush with the shaft axis. In FIGS. 8*b* the rolls 14' are shown in the retracted position in which the screen opening 13 is exposed to allow a better view into the interior of the screen. This position is set after the carrier beam 8 has been brought into the interior of the screen together with the doctor device. The guide position of the rolls 14' is shown with a dashed line in FIG. 8*b*. It is also useful and advantageous that the adjustability of the distance between the guide rolls 14' allows the adaptation to carrier beams 8 with different cross sections or distances between the holding rails 16. Naturally other structures are conceivable for displacing the rail guide parts or the guide rolls in a lateral direction. In particular it is advantageous that the shaft 144 may be pivotally and fixedly mounted by its end opposing the roll about an axis perpendicular to the shaft axis. In FIG. 8*a*, for example, a pivot direction S in a vertical plane is shown by a dashed line.

As apparent From FIGS. 1 to 8*b* holding rails 16 are attached to the lateral longitudinal sides of the carrier beam 8 and extend parallel to the latter, and may be usefully formed as simple angle rails 16*a* or as angle rails 16*b* with a downwardly bent flange partially encompassing the guide rolls 14 in accordance with FIGS. 6*a* to 6*d*, in conformity with the embodiment with sliding blocks 15 and guide rolls 14, 14', with or without guide flange 14*a*, attached to the screen mounting 5. The holding rails 16 do not extend over the whole length of the carrier beam 8 but rather terminate short of each end face of the latter so that, on the one hand, the rail-free mounting of the carrier beam 8 on the carrier beam holders 11 arranged at both end faces of the printing unit is possible and, on the other hand, the rails 16 of the carrier beam 8 come to lie inside the rotary screen 3 entirely outside the rail guide 140 after the carrier beam has been introduced into the rotary screen 3 so that the carrier beam 8 may be lowered into its printing operation position unhindered by the rail guided assembly.

As shown in FIGS. 7*a* to 8*b* a carrier beam mounting 11 advantageously comprises a height-adjustable pillar stand 17 with carrier beam seat 18 on the apparatus frame at the mounting side of the printing unit. By means of the height-adjustable stand 17, the carrier beam seat 18 is lowered to below the rotary screen opening on introducing or removing the doctor device into or out of the rotary screen 3 so that the longitudinal motion of the carrier beam 8 with the downwardly extending doctor device is not impeded when the carrier beam rails 16 are placed on, or removed from, the guide parts 14'. After the doctor device has been put into rotary screen 3 by means of the rail guide 140 the height-adjustable stand 17 is displaced upwardly into the printing operation position so that that the mounting end of the carrier beam 8 may then be laid on the carrier beam seat 18. At the opposing end face of the apparatus the carrier beam mounting need not be height-adjustable or removable, but can be provided at the height associated with the doctor arrangement operating position.

The carrier beam sits pivotally on its seat 18. To this end a mounting inner portion 18' with a semi-circular cross section is pivotally set into the correspondingly formed mounting shell seat 18 according to FIGS. 7*a* and *b*. The carrier beam of rectangular cross section positively engaged in an associated upwardly open rectangular receptacle of the mounting inner portion 18'. According to FIGS. 8*a* and *b* the mounting end of the carrier beam has a circular section. This mounting end can be pivotally laid directly in the upwardly open partially circular sectioned shell of the seat 18. By means of a clamming device, for example of the kind shown in FIG. 6*a*, the pivot position of the carrier beam can be fixed.

According to another embodiment shown in FIGS. 1 to 5*b* a carrier beam holder 11 comprises, at least at the end face of the apparatus at which the mounting or dismounting of the doctor device is effected, a pillar stand 19 fixed to the apparatus and a double arm with a bearing arm 20 arranged on the pillar stand and pivotal about the vertical stand axis 20*b*. The bearing arm 20 comprises a roughly semi-circular sectioned, upwardly open bearing seat 20*a* at its free end for receiving a bearing block 22 fixedly disposed at the underside of the carrier beam 8. The side of the bearing block 22 distant from the carrier beam 8 is rounded to correspond with the semi-circular form of the seat 20*a*. The double arm also comprises a holding arm 20*c* which is angularly displaced from the bearing arm 20 by 90° and firmly connected to a vertically upwardly protecting support rod 23. The upper end of the support rod 23 forms a bearing which is associated with the rail 16*b* and arranged at the same height as the rail guide 140. The pillar stand 19 is arranged at the apparatus such that, when in one double arm angular position, the bearing arm 20 comes to lie with its seat 20*a* under the carrier beam 8 to receive the bearing block 22, while in the other double arm angular position rotated about 90°, the bearing arm 20 is rotated out of the region of the carrier beam 8 and instead the support rod 23 comes to stand under one carrier beam rail 16*b* with the holding arm 20. The bearing end or the supporting rod 23 is used to support and guide the carrier beam 8 supplementally during mounting and dismounting.

In FIG. 6*d* a variant structure for the bearing seat or the carrier beam holder 11 is shown. A bearing book 22' firmly attached to the carrier beam 8 provided with a semi-circular, upwardly open receptacle into which a bearing arm 20' penetrates with a spherically formed part.

Figure 4:
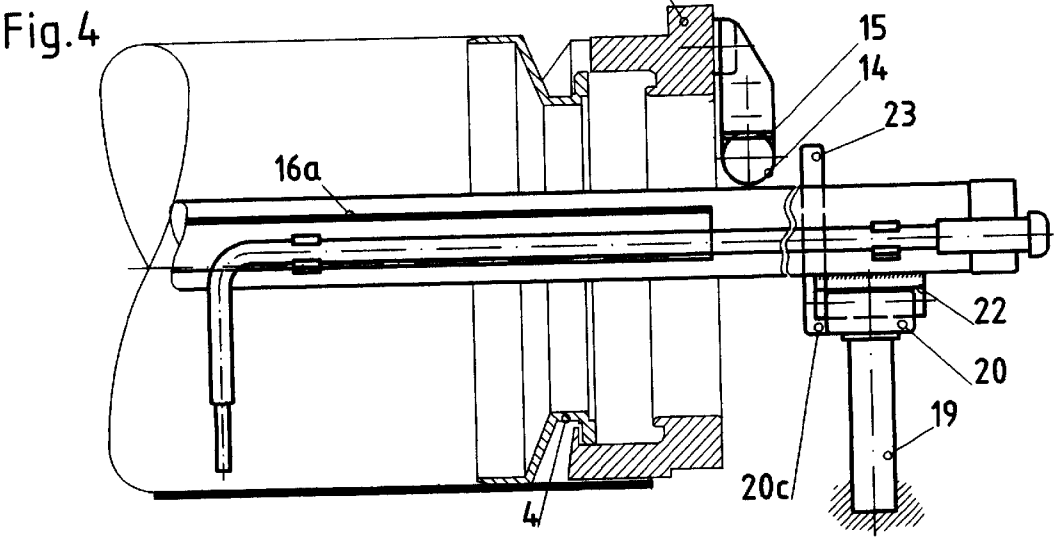
FIG. 4 is a partial longitudinal side view of the apparatus of FIG. 3 in partial section without showing the doctor device.

The apparatus according to the invention according to FIGS. 1 to 5*b* will be described in more detail by means of examples in the following. In FIGS. 3 and 4 the doctor arrangement is located inside the rotary screen in the printing operating position. As apparent from FIG. 3 the magnetizable roll doctor 7 lies in the region of the magnet block 6 on the inner side of the rotary screen 3 and is held against the working motion direction B by means of the holding strip 9. The substance level sensor 12 stands in contact with the colour substance 24 to determine the stock of colour in front of the roll doctor 7. The pivotal bearing arm 20 of the carrier beam holder 11 is located in the pivoted position perpendicular to the carrier beam axis and the free rounded end of the bearing block 22 of the carrier beam 8 engages with the semi-circular bearing seat 20*a* of the bearing arm 20. The bearing block 22 is fixed in the seat 20*a* by a pneumatic clamp device 25, for example, (FIG. 6) so as to fix the desired angular position of the doctor device.

Figure 5B:
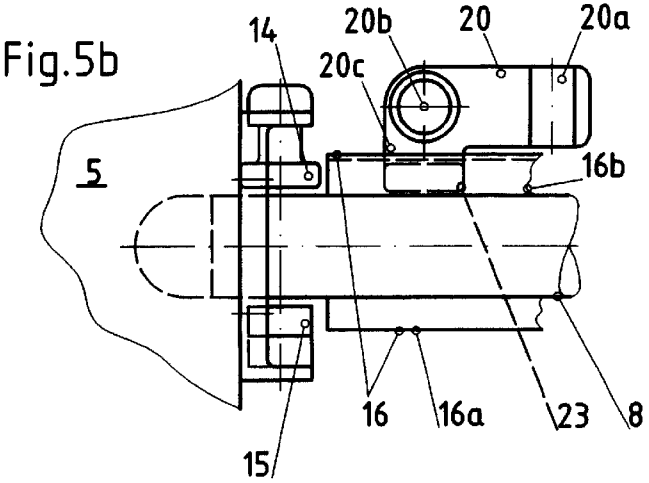
FIG. 5*b* is a top view of the holding apparatus of FIG. 5*a;*
Figure 5A:
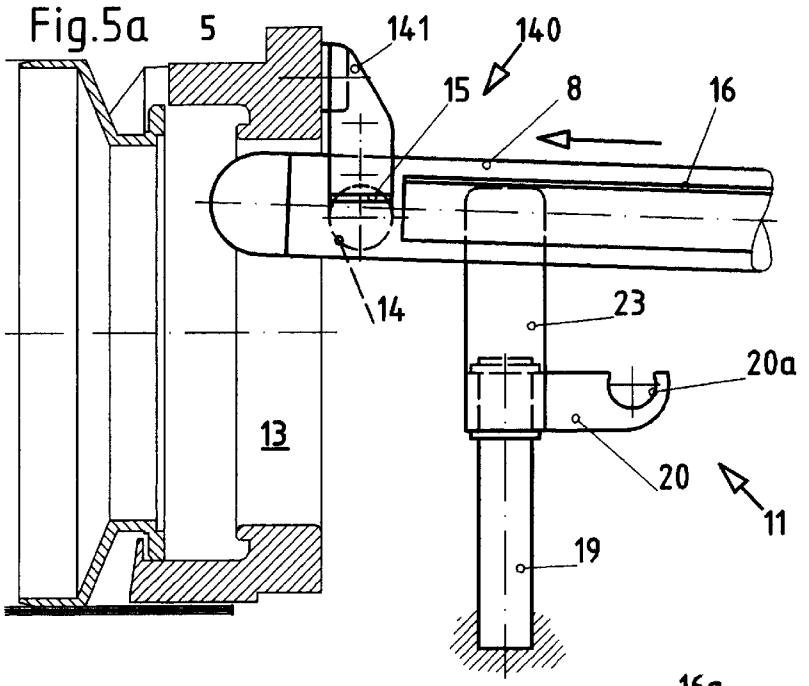
FIG. 5*a* is a partial longitudinal side view in partial section in the region of the installation side of an apparatus according to the invention with holding apparatus.
Figure 6:
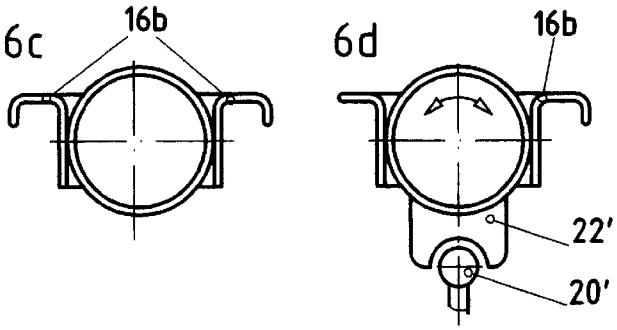
FIG. 6*a* shows a carrier beam swivel mounting and associated clamp device of an apparatus according to the invention in sectional profile.
FIGS. 6*b* and 6*c* is an end face sectional view of the pipe-shaped carrier beam with angle rails of the apparatus according to the invention.
FIG. 6*d* is an end face sectional view of a pipe-shaped carrier beam with angle rails and pivot mounting.
Figure 6:
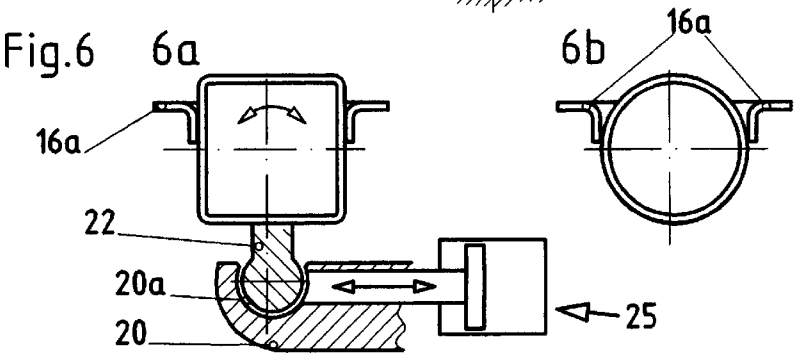
Figure 7A:
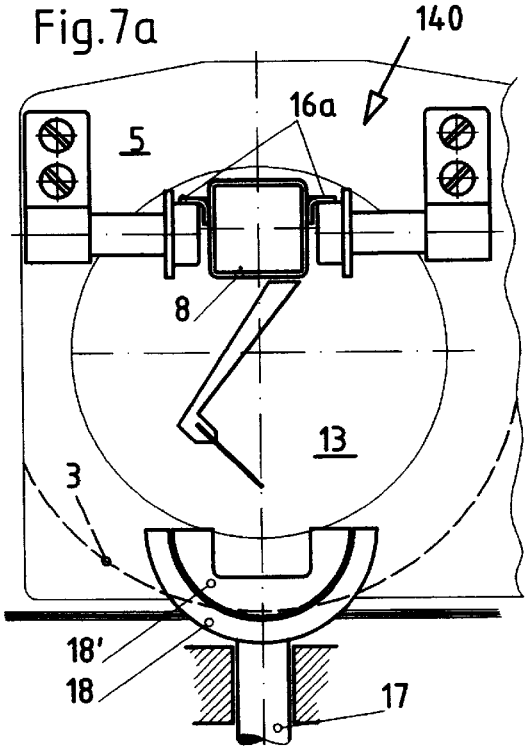
FIGS. 7*a* to 8*b* is an end face view of the apparatus according to the invention with height-adjustable carrier beam holders for circular or rectangular cross-sectional carrier beam ends.
Figure 7B:
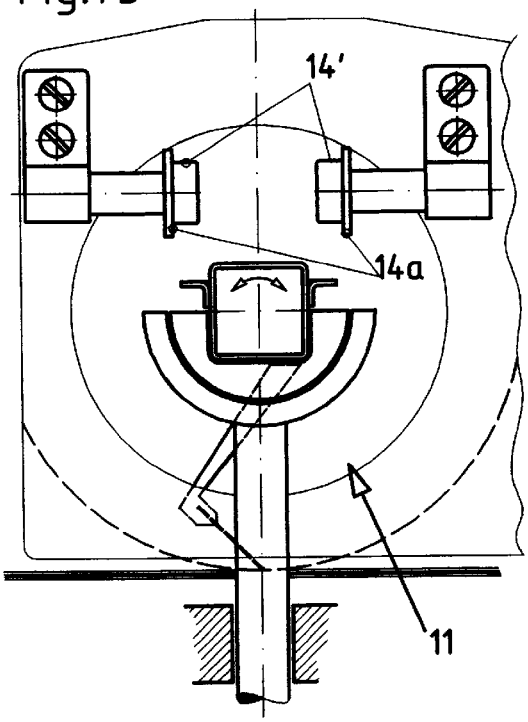

In order to dismount the doctor device the fixing of the bearing block 22 in the bearing seat 20*a* is released and the carrier beam 8 is raised and set with its angle rails 16*a*, 16*b* on the guide roll 14 and sliding block 15 (FIGS. 1 and 2). As the carrier beam rails terminate within the rotary screen 3 the doctor arrangement can be comfortable lifted without impediment from the rail guide 140 arranged outside the screen. The bearing arm 20 is rotated out of its position transverse to the carrier beam axis by 90° so that its free end points away from the screen mounting opening 13 and it does not lie in the region of the doctor device below the carrier beam 8 during the extraction of the doctor arrangement. At the same time the support rod 23 is rotated into a position in which its bearing lies at the same height as the guide roll 14 so that the support rod 23 forms a supplementary support and guide element for the angle rails 16*b* and so additionally holds and guides the carrier beam 8 with the doctor device at least in the final phase of extraction out of the rotary screen 3, particularly when the angle rails 16*a*, 16*b* leave the rail guide or lie outside the latter (FIGS. 5*a* and 5*b*). The procedure for mounting the doctor device occurs correspondingly.

Figure 9B:
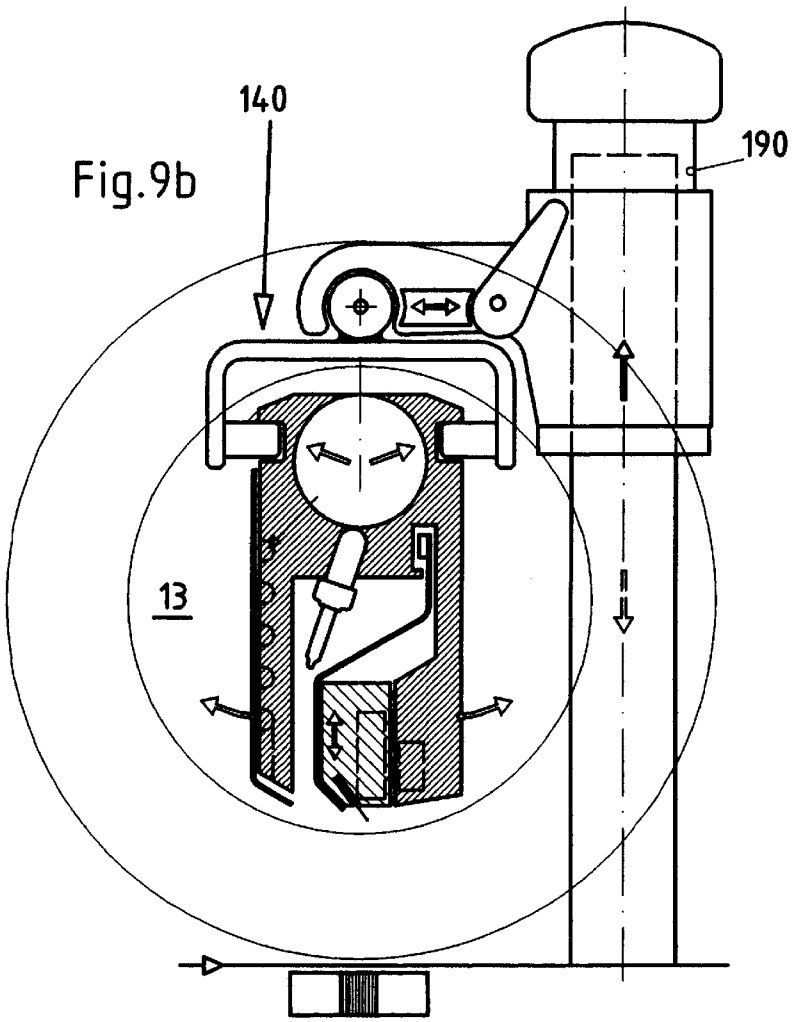
FIGS. 9*a* and 9*b* are end face views of an apparatus according to the invention with a rail guide forming the carrier beam holder.
Figure 9A:
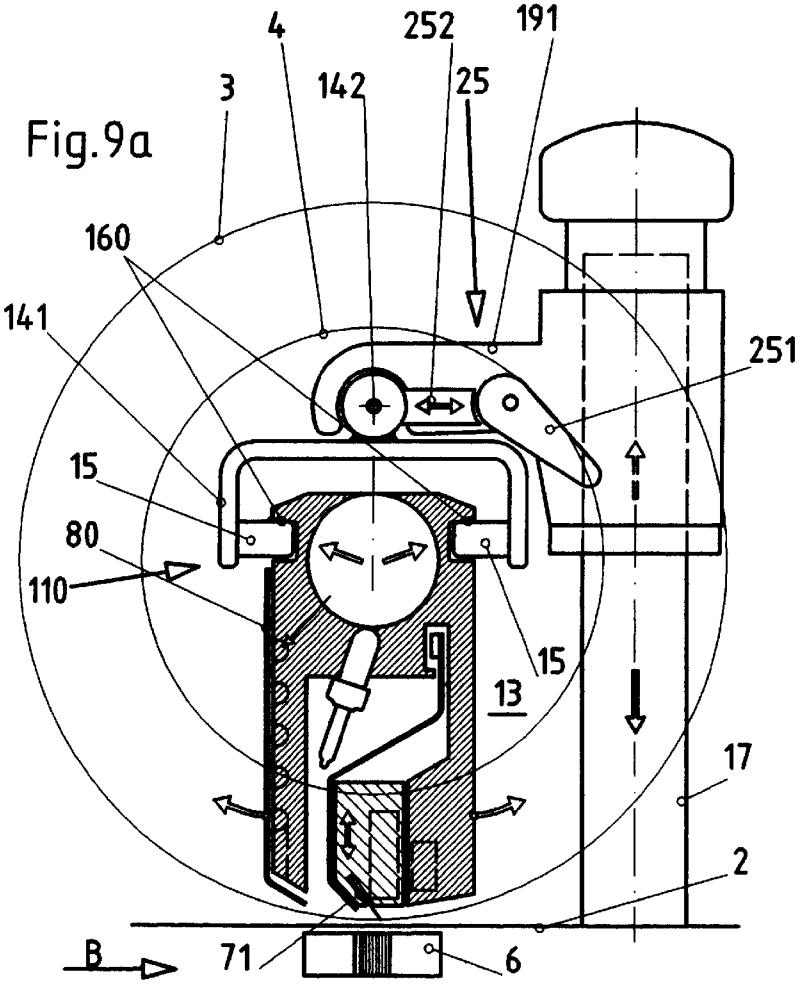

FIGS. 9*a* and 9*b* show an embodiment of the invention with a rail guide 140 which particularly advantageously simultaneously forms a carrier beam bearing 110.

As in the other embodiments, the rail guide 140 is arranged at the apparatus end face immediately in front of the screen mounting circular opening 13. The rail guide 140 comprises a downwardly open U-shaped stirrup 141 an the tree legs of which sliding blocks 15 extend spaced into the interior of the stirrup, the upper part of a carrier beam 80 being suspended between the sliding blocks.

A short bolt 142 is attached centrally to the web portion of the stirrup 141 and is retainably set in a suspension bearing receptacle having a corresponding circular cross section. To this end, the downwardly open receptacle encompasses the bolt by about 270°. The bearing bolt 142 is pivotal in the receptacle about an axis parallel to the longitudinal axis of the application apparatus so that the stirrup 140 is arranged to pivot about this bearing axis. The bolt and therefore the stirrup 141 can be fixed in the desired rotational position by means of a clamping device 25 which comprises an eccentric fixing element 251 and a clamping piece 252 co-operating with the latter. In the embodiment, the stirrup web is located in a horizontal position, as a result of which the carrier beam suspended from rails is arranged in a vertical position.

The bolt suspension bearing for the stirrup and the clamping device are formed and arranged on a pillar arm 191 in the region in front of the opening 13. The pillar arm 191 is mounted on a height-adjustable pillar stand 190. The pillar stand 190 is arranged on the application device at the end face in the region outside the opening 13. By means of the height-adjustable pillar stand 190 the rail guide 140 can be arranged on the apparatus with its distance from the application surface 2 being modifiable and fixable.

The carrier beam 80 is formed by a one-piece block structure extending over the working width, a width distribution device that comprises a substance supply channel with circular cross section in the upper portion of the carrier beam 80 being incorporated in the structure. Vertical channels starting from the circular cross section are worked into the frontal carrier beam wall, as viewed in the working motion direction B, that extends up the screen inner wall in operating position, the substance exiting uniformly across the width immediately in the region in front of a doctor blade 71. A magnetizable body is associated with the doctor blade 71 by means of which the latter can be pressed against the rotary screen 3 or the application surface 2 by means of a magnet block 6 arranged below the application surface 2.

A rail 160 is incorporated in the upper carrier beam portion at the same height on each longitudinal side of the carrier beam 80. These rails 160 are formed as grooves that are continuous over the whole length of the carrier beam and into which the sliding blocks 15 penetrate as sliding tongue elements at the end face region in front of the opening 13.

In the position shown in FIG. 9*b* the carrier beam 80 is located in the mounting/dismounting position. The stand 190 is raised such that the suspension stirrup 141 is located in the upper region in front of the opening 13. In this position the carrier beam is inserted for suspension in the stirrup 141 from the end side of the apparatus by placing the groove rails 160, which are open at the carrier beam end face, between the sliding block springs 15. The carrier beam 80 is then inserted through the entire length of the screen and laid on an end face carrier beam mounting, which can advantageously likewise be constituted by the described stirrup rail suspension, from the inside of the screen at the other end face. As apparent from FIGS. 9*b* almost the entire diameter of the opening 13 be made use of for the cross section of the carrier beam. The extraction of the carrier beam 80 out of the rotary screen is effected in the correspondingly inverse manner.

When one assumes that the mounting position of the carrier beam 80 is shown in FIG. 9*b*, it being useful to leave the clamping device 25 released so that the carrier beam 80 can hang vertically downwards as a result of its own weight, driving the pillar stand 190 downwards and thereby lowering the stirrup 141 will cause the carrier beam 80 to be lowered out of the illustrated position into the operating position shown; FIG. 9*a*. At the other end face of the apparatus the carrier beam mounting is simultaneously lowered by the same amount. After the carrier beam 80 has been positioned in the operating position according to FIG. 9*a* the position of the stirrup 141, with which the carrier beam 80 is connected and fixed as a result of the tongue/groove rail connection to prevent rotation with respect to the axis of the bolt 142, can be locked.

It is achieved that the carrier beam 80 is never handled freely or without guidance in the mounting/dismounting phase.

Since the stirrup 141 is suspended by the hinge bolt 142 and the carrier beam 80 is suspended by the rail guide 140 the doctor device remains free and unobstructed over the entire length of the apparatus, and specifically also in the end face regions of the apparatus.

Figure 10B:
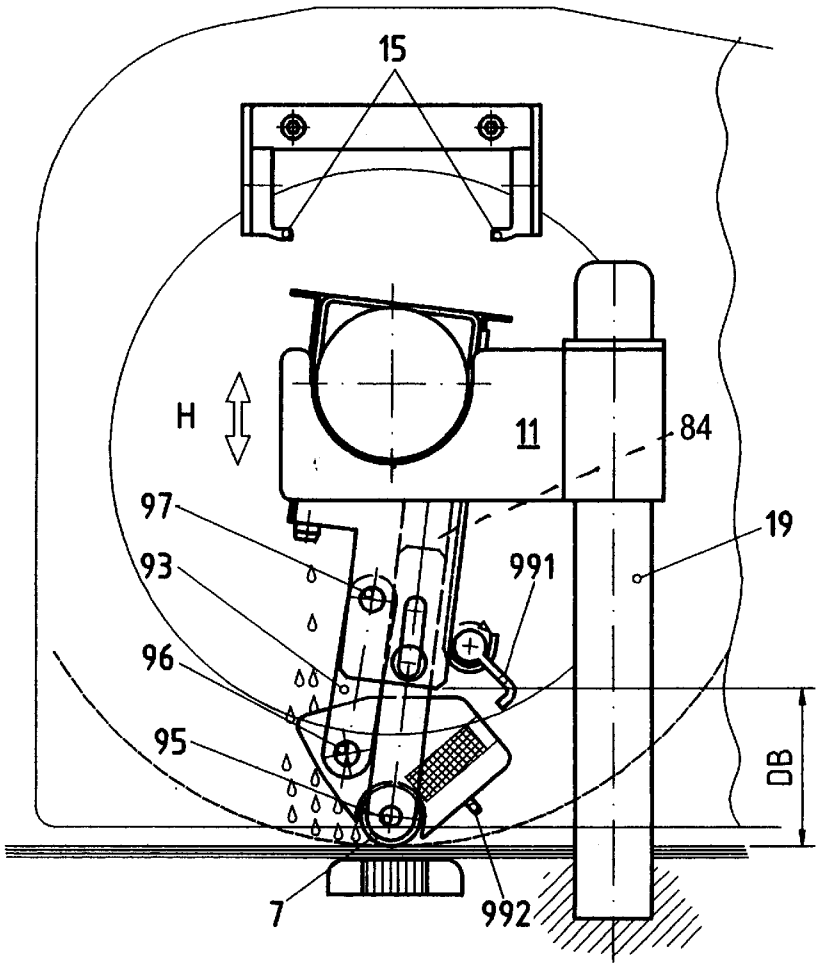
FIGS. 10*a* and 10*b* are end face views of an apparatus according to the invention with a doctor device that is blockable in a collapsed position.
Figure 10A:
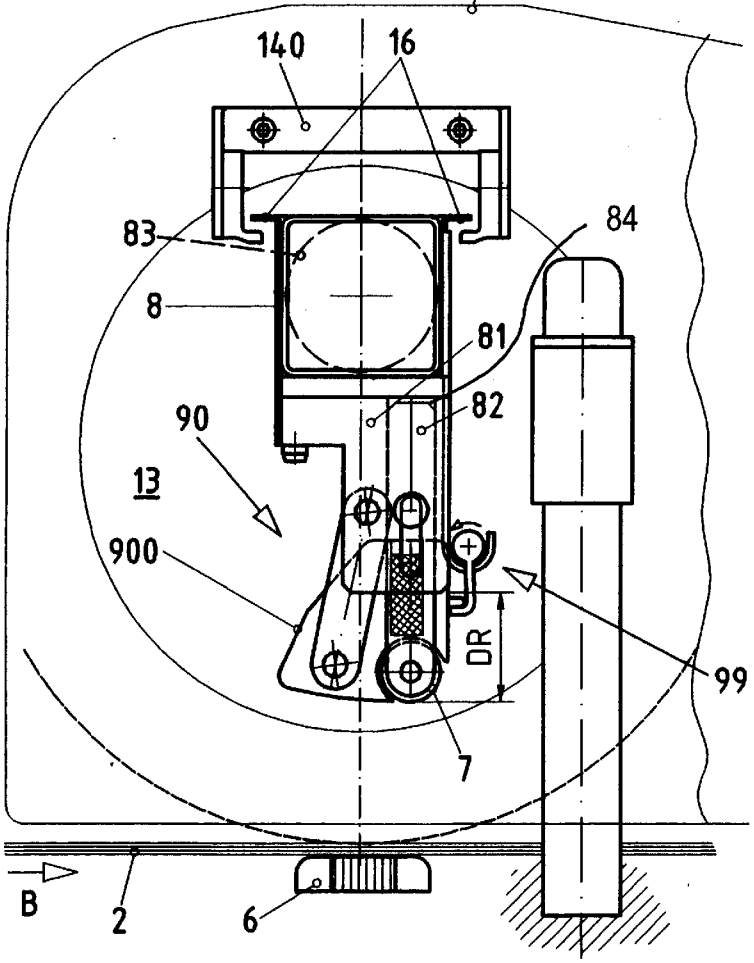

In FIGS. 10*a* and *b* the rail suspension and guidance according to the invention is provided in a corresponding manner to that for earlier described embodiments. A particular feature is that a doctor device 90 comprises a doctor holding portion 900 in the form of a doctor profile strip which is movably mounted on the carrier beam 8 with two degrees of freedom.

One of these degrees of freedom is defined by a linear telescope-like rail guide by means of which the doctor holding portion 900 is displaceable translationally and transversely to the application surface 2. The other degree of freedom is defined by the rotational movability of the doctor portion 900 about a doctor 7 with circular cross section. The doctor portion 900 is retainably connected to the carrier beam 8.

By means of the sliding pivot hinge connection of the doctor portion 900 the doctor 7 can be brought into a position in which the distance from the doctor 7 to the carrier beam 8, or a carrier portion 81 firmly connected to the latter, is minimal. Between the carrier beam 8 and the doctor holding portion 900 are provided locking means 99 with which the position of the doctor holding portion 900 is releasably fixed at the minimum spacing DR. In this position the installation cross section, which must be sufficiently smaller than the cross section of the screen mounting opening 13 is reduced to a minimum. The doctor device 90 which is collapsible and lockable in the described manner can be comfortably installed and dismounted, it being essential that after unlocking the locking means 99 the doctor device 90 forms a functional doctor unit which, with regard to the distance between doctor 7 and carrier beam 8, can also be operated with a maximum distance which corresponds to the maximum profile section of the device 90 and with which the installation would be difficult or even to a doctor device section which is larger than the section of the opening 13.

The operating position with maximum distance DB between doctor 7 and carrier portion 82 is shown in FIG. 10*b*. Carrier beam mounting ends 83 with circular cross section are mounted for rotational movement in a height-adjustable carrier beam mounting 11. To allow adjustment the carrier beam 8 can be freely rotationally movable. During doctor operation it can be fixed using not shown means.

The locking means 99 is formed by a locking hook 991 which is pivotally hinged to the carrier portion 81. A corresponding locking part 992 in the form or a projection, an undercut or the like is associated with the hook 991 and attached to the doctor holding portion 900. Practically all releasable locking connections are conceivable for the locking connection, a magnetic holding lock could also usefully be provided in place of a mechanical snap, hook or lock connection.

As likewise apparent from FIGS. 10*a* and *b* the working angle of the doctor holding portion 900 is adjusted by means of the height adjustment E of the carrier beam mounting 11. Upon reducing the height distance the working angle becomes flatter. At the same time the doctor 7 remains lying in the plane of guidance allowed by the translational displacement. To this end the doctor holding portion 900 is held to move pivotally about two pivot bearing axes 95 and 96 extending in, and parallel to, the apparatus length. The doctor holding portion 900 is hinged at the free lower end of a rod-like holding arm 82 close to the application surface 2 to move pivotally about the first pivot axis 95. This axis 95 lies in the translational sliding guide plane which is formed by a linear sliding recess 84 provided at a steeply inclined position to the application surface 2 and into which the arm 82 engages for sliding movement. The second pivot bearing axis 96 is constituted by a rotary bearing likewise arranged on the end face of the holding portion 900. This hinge connection comprises a hinge arm 93 which hinges the holding portion 900 to one of its ends about the axis 96 and is pivotally joined at the other end to the carrier portion 81. A magnetizable body with which the doctor pressing is effected under the action of a magnet block 6 arranged underneath the application surface 2 is embedded in the doctor holding portion 900.

I claim:

1. An application apparatus for applying substance, comprising:

a perforated cylinder rotary screen adjacent a moving application surface to which the substance is applied;

a carrier beam extending along a length of the apparatus across a width of the application surface;

a doctor device connected to the carrier beam;

a carrier beam mounting arranged at an end face of the apparatus for mounting the carrier beam at its opposite ends outside the application surface width;

at least one holding rail formed on the carrier beam continuously over at least a majority part of a length of the carrier beam;

a rail guide that receives and guides said at least one holding rail during mounting and dismounting of said carrier beam that is provided in a region of at least one end face of the apparatus; and said doctor device being disposed to oppose the moving application surface at an underside of the carrier beam.

2. An apparatus according to claim 1, further including two of said at least one holding rails formed on an upper portion of the carrier beam and facing away from the moving application surface.

3. An apparatus according to claim 1, wherein said rail guide comprises rail guide parts arranged in pairs including rolls and sliding blocks, the rail guide parts being provided on lateral longitudinal sides of the carrier beam.

4. An application apparatus according to claim 3, further including means for transversely displacing the rail guide parts with respect to the carrier beam to selectively adjust a distance between the rail guide parts.

5. An application apparatus according to claim 3, wherein said rail guide comprises a U-shaped holding stirrup that opens toward the application surface and having free leg ends on which are mounted said rail guide parts.

6. An application apparatus according to claim 5, further including holding part means for pivotally supporting the holding stirrup in suspended arrangement to pivot about an axis parallel to a longitudinal axis of the apparatus, wherein said holding part means includes a clamping device for fixing a pivotal position of the holding stirrup.

7. An application apparatus according to claim 6, further including means for adjusting a position of said holding part means to enable corresponding adjusting of said rail guide with respect to a distance between the rail guide and the moving application surface.

8. An application apparatus according to claim 1, further including at least one bearing for supporting said perforated cylinder rotary screen in rotation that is disposed at an end face of the apparatus, said at least one bearing including an end face through hole corresponding to a screen end face opening, and wherein the rail guide is mounted at the end face in front of the through hole in an upper region of the through hole, and further wherein the rail guide is mounted on the at least one bearing.

9. An application apparatus according to claim 1, further including said end face of the apparatus and said rail guide being mounted to said end face, the carrier beam mounting having a support element that engages said at least one carrier beam holding rail to provide an additional mounting and guide for the at least one carrier beam holding rail, wherein the support element is movable out of a moving region of the at least one carrier beam holding rail, said support element being part of the carrier beam mounting and wherein said support element has a mounting seat that is movable with respect to an underside of the carrier beam to receive said carrier beam in one position.

10. An application apparatus according to claim 9, further including a bearing arm pivotally mounted to said support element, the mounting seat being formed on the bearing arm, wherein the mounting seat is movable to another position completely out of a region below a carrier beam during installation and removal of the carrier beam.

11. An apparatus according to claim 9, further including bearing blocks mounted on an underside of the carrier beam and having edges arranged to be received in the mounting seats.

12. An application apparatus according to claim 1, further including means for adjustably supporting said rail guide to adjust a distance between said rail guide and said application surface and means for supporting said rail guide to enable and set a position of rotation about an axis extending along a length of the apparatus.

13. An application apparatus according to claim 1, wherein the at least one holding rail is formed along said majority part of the length of the carrier beam and spaced from respective ends of the carrier beam.

14. An application apparatus according to claim 1, further comprising height-adjustable carrier beam mounting seats and means for supporting said rail guide to enable and set a position of rotation about an axis extending along a length of the apparatus.

15. An application apparatus according to claim 1, further including a doctor holding portion connected to the carrier beam and movable relative to the carrier beam in a direction transverse to a longitudinal axis of the carrier beam between an operating and installation and removal positions, and locking means arranged between the carrier beam and the doctor holding portion for locking the doctor holding portion in a position suitable for installation and removal of the carrier beam.

16. An application apparatus according to claim 15, further including means for supporting said doctor holding portion to enable and set a position of rotation about an axis extending along a length of the apparatus.

17. An application apparatus according to claim 16, further including telescope-like displacement means mounted on the carrier beam for supporting the doctor holding portion.

* * * * *